United States Patent [19]

Henderson

[11] Patent Number: 4,538,630

[45] Date of Patent: Sep. 3, 1985

[54] MICROWAVE HEATED HAIR CURLER

[76] Inventor: Gordon W. Henderson, 240 S. Case Ave., Westmont, Ill. 60559

[21] Appl. No.: 474,134

[22] Filed: Mar. 10, 1983

[51] Int. Cl.[3] ..... A45D 2/12

[52] U.S. Cl. ..... 132/33 R; 219/10.55 A

[58] Field of Search ..... 132/33 R, 40, 42, 41, 132/39; 34/4; 219/10.55

[56] References Cited

U.S. PATENT DOCUMENTS

| | | | |
|---|---|---|---|
| Re. 26,766 | 1/1970 | Jorgensen | 132/33 R |
| 3,541,302 | 11/1970 | Makino | 132/33 R |
| 3,585,357 | 6/1971 | Mandell | 132/33 R |
| 3,632,971 | 1/1972 | Flanagan | 132/33 R |
| 3,706,315 | 12/1972 | Johansen | 132/33 R |
| 3,773,057 | 11/1973 | Johansen | 132/33 R |
| 3,980,855 | 9/1976 | Boudouris | 219/10.55 R |
| 4,109,667 | 8/1978 | Quirk | 132/33 R |

*Primary Examiner*—Gregory E. McNeill

*Attorney, Agent, or Firm*—Hill, Van Santen, Steadman & Simpson

[57] ABSTRACT

A hair winder spool containing a lossy dielectric material and a heat sink material is rapidly heated in a microwave oven to hair curling and drying temperatures which are maintained for a sufficient length of time to dry and curl hair wound around the spool. The spool is a hollow molded low loss dielectric plastics material spindle with hair retaining protruberances and radially projecting end flanges. The interior of the spindle is filled with a heat sink material having a melting point temperature within the range desired for drying and curling the hair wound around the spindle and also having a high heat of fusion. The lossy dielectric material may be in the form of a core in the cylinder surrounded by the heat sink material, a lining or coating on the cylinder wall surrounding the heat sink material or a matrix embedded in the plastics material. The lossy dielectric material absorbs microwave energy converting it into thermal energy and heats the spool to hair drying and curling temperatures when placed in a microwave field for a very short time. The hair winders are conveniently packaged in a casing which is relatively insensitive to microwaves to be comfortably handled when removed from a microwave oven after the winders are heated to operating temperatures.

12 Claims, 7 Drawing Figures

MICROWAVE HEATED HAIR CURLER

BACKGROUND OF THE INVENTION

1. Field of the Invention

This invention relates to devices for drying and curling hair which are rapidly heated in microwave ovens and retain heat for a prolonged time. Specifically, the invention deals with low loss dielectric material hair winder or curler spools containing a lossy dielectric material and a heat sink material effective to heat the spool to hair curling temperatures when exposed to microwaves for a very short time and then retain hair curling temperatures for a prolonged time period.

2. Prior Art

Hair winders for use in drying and curling hair have been provided in the form of molded plastics material cylinders or spools heated by steam or hot water or having hollow cores fitting around electrically heated fingers. These prior known hair winders or spools required a lengthy pre-heat time before reaching operating temperatures. They also required cumbersome heating equipment such as steam generators, electrical finger heaters for receiving the spools, and the like.

It would therefore be an improvement in this art to provide microwave heated hair curlers or winders which reach operating temperatures in less than a minute or so when exposed to microwaves and retain the operating temperatures over a long period of time.

SUMMARY OF THIS INVENTION

According to this invention, there is provided hair winder devices formed from low loss dielectric material, such as plastics and containing lossy dielectric material which are rapidly heated in a conventional microwave oven to temperatures sufficient to dry and curl hair wound therearound and maintain effective temperatures over a long period of time.

The curlers of this invention are preferably in the form of hollow molded plastics material spools with cylindrical surfaces around which hair is easily wound. These surfaces have projecting nubbins or ridges to retain the wound hair. Radial flanges or hubs on the ends of the spool are connected to the spool body only through spokes to insulate the hubs so that they may be comfortably grasped when winding hair around the heated cylindrical portion. The spool body is preferably an inexpensive easily molded material such as a polyolefin, a polyvinyl chloride, or the like relatively low loss dielectric material having a softening point well above hair drying and curling temperatures.

The lossy dielectric material may be in the form of a core in the hollow interior of the spool, a coating or lining on the interior wall of the spool, or a matrix mixed in the plastics molding material. The lossy dielectric materials have good Faraday rotation and magnetic resonance properties. Preferred materials include ferrites, particularly those containing magnesium and manganese. A thermostating ferrite matrix referred to as "TFM", introduced by Raytheon Co. of Lexington, Mass. is useful. Zirconium dioxide is also preferred.

The hollow spool is filled with a heat sink material effective to maintain operating temperatures over a long period of time. Suitable materials have a melting point within the range of temperatures desired for drying and curling hair plus a high heat of fusion. Suitable materials include waxes, such as parafin, caustic soda, and metal salts, such as erythrite. These materials should have melting points within the range of 60° to 130° C. and a high heat of fusion of about 40 to 80 calories per gram.

The lossy dielectric material is used in amounts to absorb microwave energy converting it into thermal energy heating the heat sink material to its melting point in a microwave oven in a very short time, preferably less than 1 minute.

The spools preferably have a length of $2\frac{1}{2}$ to 3 inches, a diameter of about $\frac{3}{4}$ to $1\frac{1}{4}''$ with the hub ends extending to $1\frac{1}{4}$ to $1\frac{1}{2}''$. The plastics material need only be about 1/16 to $\frac{1}{8}''$ thick. The spool is preferably in the form of a cylindrical cup with a closed bottom end and a top closed by a cap or an integral top wall having a filler opening that is closed by a plug.

A spot of heat sensitive color changing pigment may be placed on the top end wall to indicate when the interior of the container has reached the operating temperature range.

It is then an object of this invention to provide hair curlers which are rapidly heated to operating temperatures in microwave ovens and retain the operating temperatures over a prolonged time period.

Another object of this invention is to provide hair winders containing lossy dielectric material effective to rapidly absorb microwave energy, convert it into thermal energy, and heat a hair receiving surface of the curler to temperatures for drying and curling hair wound therearound.

A specific object of this invention is to provide a hollow hair winder spool composed of low loss dielectric material and containing a lossy dielectric material and a heat sink material.

Other and further objects of this invention will be apparent to those skilled in this art from the following detailed description of the annexed sheet of drawings which show several preferred embodiments of this invention.

ON THE DRAWINGS

AS SHOWN ON THE DRAWINGS

Figure 1:
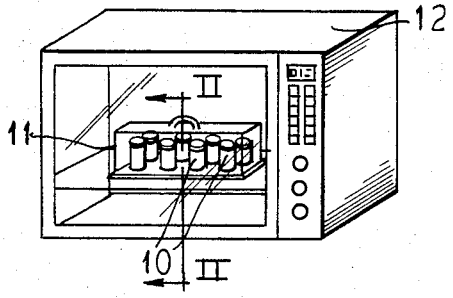
FIG. 1 is a perspective view of a microwave oven with a package of hair curlers of this invention therein.
Figure 2:
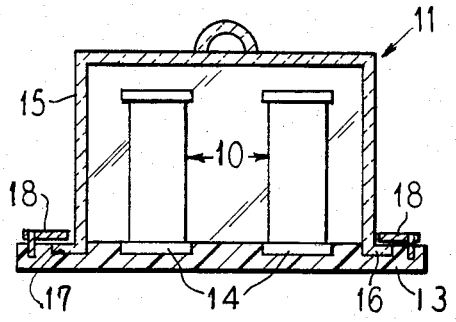
FIG. 2 is a cross-sectional view of the package of hair curlers taken along the line II—II of FIG. 1.

The hair curlers 10 of this invention are illustrated in FIG. 1 as encased in a box-like package 11 inserted in a conventional microwave oven 12. The package 11, as better illustrated in FIG. 2, includes a tray 13 with pockets 14 in its top face receiving the bottoms of the curlers 10 to hold them in upright position. A cover 15 surrounds the curlers 10 and has a bottom peripheral outwardly flanged edge 16 seated in a receiving groove 17 in the top of the tray. Fingers 18 pivoted on the tray are adapted to be swung over the flange 16 to retain the cover on the tray. The package is inert to the microwave field in the oven 12 and can be a clear thermoset plastics material. The curlers are held by the tray 14 in spaced relation to be fully exposed to the microwaves.

Figure 3:
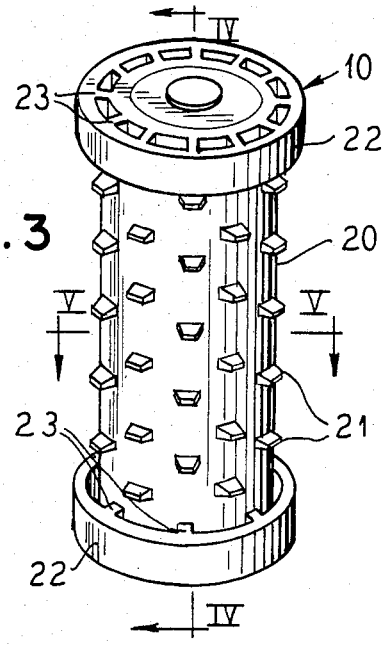
FIG. 3 is a perspective view of a hair curler of this invention.

Each curler 10, as illustrated in FIG. 3 is a plastics material hollow spool with a cylindrical spindle 20 having protruberances 21 therearound for retaining strands of hair to be wrapped around the spindle. The ends of the spindle have circular hubs 22 connected thereto by circumferentially spaced spokes 23 so that the peripheries of these hubs are somewhat heat insulated from the spindle.

Figure 4:
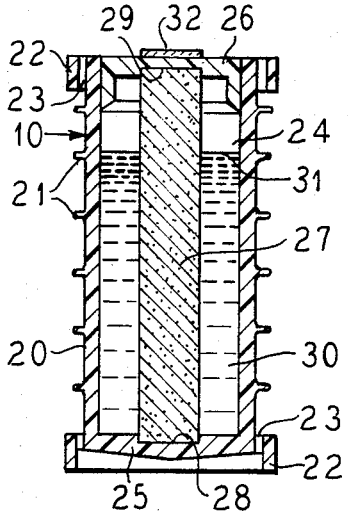
FIG. 4 is a longitudinal cross-sectional view along the line IV—IV of FIG. 3.
Figure 5:
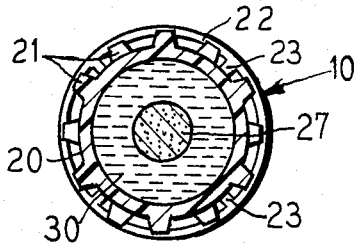
FIG. 5 is a transverse cross-sectional view along the line V—V of FIG. 3.

As illustrated in FIG. 4, the spool 10 is hollow having a cylindrical interior chamber 24 closed at the bottom by an integral end wall 25 and at the top by a plug 26 press-fitted into and integrally sealed therewith. A core 27 of lossy dielectric material extends through the center of the chamber 24 having a bottom end seated in a pocket 28 of the end wall 25 and a top end seated in a pocket 29 of the plug 26.

The chamber 24 is filled with a heat sink material 30 surrounding the core 27. To allow for expansion during the heating of the heat sink material 30, the level 31 of this material is illustrated below the end cap or plug 26.

A spot 32 of heat sensitive color changing pigment is provided on the central portion of the end cap or plug 26 to change, for example, from blue to red when the temperature of the curler reaches its operating range and the heat sink material has gone beyond its heat of fusion temperature.

Figure 6:
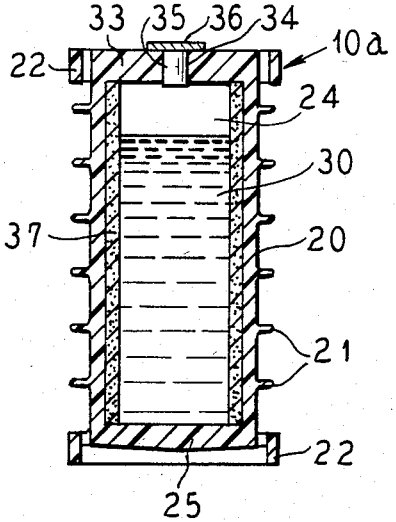
FIG. 6 is a longitudinal sectional view through a modified hair curler of this invention.

In the modified hair curler 10*a* of FIG. 6 parts identical with parts described hereabove have been marked with the same reference numerals. In FIG. 6 the hollow interior of the spool is closed by an integral top wall 33 having a central pour hole 34 closed by a plug 35, the top of which has the color changing heat sensitive pigment 36. The heat sink material 30 can be introduced into the chamber 24 through this pour hole 34 and sealed therein by the plug 35 which can also act as a pressure release blow-out in the event the heat sink material is inadvertently heated above its boiling temperature.

Instead of providing the lossy dielectric material in the form of a core as in the curler 10, the curler 10*a* has this material in the form of a coating or liner 37 on the interior cylindrical wall of the chamber 24. The liner preferably does not extend over the end walls 25 and 33 because it is primarily intended to heat the cylindrical spindle portion 20 while leaving the ends at a comfortable temperature. The liner 37 can be in the form of a coating or a sleeve of the lossy dielectric material.

Figure 7:
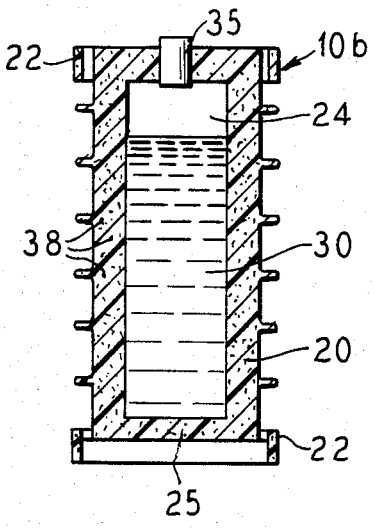
FIG. 7 is a view similar to FIG. 6 but showing a further modified form of hair curler.

In the further modified curler 10*b* of FIG. 7, parts corresponding with parts described hereinabove have been marked with the same reference numerals. In the curler 10*b*, however, instead of incorporating the lossy dielectric material as a core 27 or as a liner 37, this material is directly incorporated as a matrix 38 in the molded plastics material forming the body of the spool, preferably being concentrated in the spindle portion 20 of the spool body. This matrix can be formed by mixing a ferrite or other lossy dielectric with the molding composition to produce a spool body having the material disposed therein.

The amounts of the lossy dielectric used in the spool will vary depending on the "hardness" of the magnetic properties of the material. Many lossy dielectrics are useful but those with high ferromagnetic resonance are preferred. In general, the "hardness" and the amounts used should be balanced to heat the spools to temperatures with the range of 60°-130° C. in about 20 seconds to one minute when exposed to the high heat cycle of the microwave oven. A core of the above referred to "TFM" material about $\frac{1}{4}$ to $\frac{1}{2}''$ in diameter and $2\frac{1}{2}''$ long is ample.

From the above descriptions it will therefore be understood by those skilled in this art, that this invention now avoids heretofore required cumbersome and expensive heating devices for hair winders or curlers by incorporating a lossy dielectric material into the curlers which will rapidly heat them to operating temperatures when exposed to a microwave field. It will also be understood that the rapidly heated curlers will retain their heat over a long use period.

While various changes and modifications might be proposed by those skilled in the art, it will be understood that I wish to include within the claims of the patent warranted hereon all such changes and modifications as reasonably come within my contribution to the art.

I claim as my invention:

1. A self-contained, sealed, microwave heatable hair winder comprising a spool of a low loss dielectric material adapted to receive hair therearound and containing a lossy dielectric material in an amount to quickly heat the spool to operating hair curling temperatures when exposed to a microwave field.

2. A self-contained, sealed, hair curler for use with a microwave field comprising a dielectric plastics material hollow spool adapted to receive strands of hair therearound and containing a heat sink material and a lossy dielectric material effective to rapidly melt the heat sink material when the spool is exposed to microwaves.

3. A self-contained sealed, microwave heatable set of hair curlers comprising a tray, a plurality of hollow spools mounted in spaced relation on said tray, a cover for the spools on the tray, said tray and cover being inert to microwaves, said spools composed of low dielectric plastics material, a heat sink material sealed in said spools, and said spools containing a lossy dielectric material of high magnetic resonance effective to heat the spools to about 60°-130° C. when exposed to microwaves for not more than about 1 minute.

4. The winder of claim 1 wherein the lossy dielectric material is a ferrite.

5. The winder of claim 4 wherein the ferrite includes cobalt and magnesium.

6. The curler of claim 2 wherein the lossy dielectric material is a core in the hollow interior of the spool.

7. The curler of claim 2 wherein the lossy dielectric material is a lining on the interior of the hollow spool.

8. The curler of claim 2 wherein the lossy dielectric material is embedded in the plastics material body of the spool.

9. The curler of claim 2 wherein the heat sink material melts at temperatures of about 60°-130° C. and has a high heat of fusion.

10. The curler of claim 2 wherein the spool has dielectric material hubs on the ends thereof radiating from a central cylindrical spindle which hubs are isolated from the spindle, the heat sink material and the lossy dielectric material to remain cool when the spool is heated by microwaves.

11. The curler of claim 2 wherein the spool is a cup having an open top providing a pour hole for the heat sink material carrying a heat sensitive color changing pigment and providing a pressure release blow out for the heat sink material.

12. The curler of claim 11 wherein the bottom of the cup and the plug have facing control recesses and a core of lossy dielectric material spans the interior of the cup with ends seated in said recesses.

* * * * *